US006561957B1

(12) United States Patent
Read

(10) Patent No.: US 6,561,957 B1
(45) Date of Patent: May 13, 2003

(54) TRANSLATIONAL EXERCISE MACHINE WITH HORIZONTAL FREE PLANAR MOTION

(76) Inventor: Richard Allen Read, 1080 Anders Rd., Lansdale, PA (US) 19446

( * ) Notice: Subject to any disclaimer, the term of this patent is extended or adjusted under 35 U.S.C. 154(b) by 0 days.

(21) Appl. No.: 10/073,578

(22) Filed: Feb. 12, 2002

(51) Int. Cl.[7] ..... A63B 69/18
(52) U.S. Cl. ..... 482/94; 5/332
(58) Field of Search ..... 482/94, 98, 100, 482/148, 142, 71, 70, 133, 79, 80, 93, 99, 114–5, 54, 901, 908, 57, 72, 134–7, 146–147; 5/332; 601/23–29

(56) References Cited

U.S. PATENT DOCUMENTS 828,221 A * 8/1906 Langel ..... 5/332
3,455,295 A * 7/1969 Kellogg ..... 5/332
3,497,882 A * 3/1970 Weeks ..... 5/332
3,834,693 A * 9/1974 Poppenberger ..... 272/57 B
5,320,372 A * 6/1994 Langen ..... 280/207
5,360,383 A * 11/1994 Boren ..... 482/10
5,454,773 A * 10/1995 Blanchard et al. ..... 482/133
5,749,668 A * 5/1998 McIlvain et al. ..... 482/79
5,749,811 A * 5/1998 Wilson ..... 482/71

* cited by examiner

*Primary Examiner*—Nicolas D. Lucchesi
*Assistant Examiner*—Lori Baker Amerson

(57) ABSTRACT

A translational exercise machine with horizontal free planar motion, has a base frame, supporting an optional upper horizontal frame with seat and backrests supporting the user, and supporting an intermediate wheeled horizontal frame, supporting an upper wheeled frame. A vertical frame with horizontal handlebar with hand/foot grips is provided, which frame is optionally attached to the upper horizontal frame, or to the upper wheeled horizontal frame. With hand or foot use of the hand/foot grips, the user can propel self and wheeled frames in any horizontal motion. Exercise is caused by acceleration of the user and wheeled frame masses in a horizontal plane, and by braking assemblies between frames.

1 Claim, 9 Drawing Sheets

30
33
32
31
2
36
34
35
43
42
41
45
40
30
44
51
52
50
10
20

20
l
23
12
24
22
21
10
26
13
11
10
25

TRANSLATIONAL EXERCISE MACHINE WITH HORIZONTAL FREE PLANAR MOTION

CROSS-REFERENCE TO RELATED APPLICATIONS

The present invention is a companion invention to the invention I submitted under Application No. 09/872,619, titled "A riding type exercise machine with horizontal free planar motion". No other similar invention was found.

BACKGROUND OF THE INVENTION

The present invention relates generally to an exercise machine, and more particularly to a translational type exercise machine with horizontal free planar motion.

In recent years the value of staying physically fit has become universally recognized, and sought after by men and women of all ages, with a high emphasis on the cardiovascular system. To this end, a wide variety of exercise equipment has been provided for use in fitness centers and in homes. Fitness centers, which have ample space and financial resources, tend to provide a variety of specialty equipment which concentrate on the exercise of very specific muscle groups. However, family units have limited space and financial resources. Consequently, families need an exercise machine which is space effective and economical, and which: can exercise the entire body with a minimal number of operations; is primarily aerobic in nature, but able to provide significant resistance for anaerobic exercise; is easy to operate and adjust, and can be operated by any member of the family, including the disabled; and has no user body impact or other detrimental affects.

Many machines which have been invented are either aerobic or anaerobic. Those machines which are primarily aerobic, such as cycles: are simple in nature, but tend to involve only the lower body, have a one directional action (not push/pull), and exercise a limited number of muscles.

Machines which are primarily aerobic, but involve the upper and lower body, such as rowing and riding machines, have a prescribed motion path, either one direction horizontally, or a combined vertical motion, and tend to have multiple simultaneous activities and multiple user body load paths (legs and arms). The multiple simultaneous activities tend to be difficult to perform. The multiple user body load paths cause the user to decide which path to emphasize, reducing the effectiveness of the other path.

Both of the above types of aerobic machines operate in a linear horizontal direction, or combine a vertical motion, but do not allow transverse motion. Consequently the use of associated muscle groups is greatly reduced.

Finally, machines which are primarily anaerobic, are either multi-functional, or concentrate on one muscle group. Because of space limitations, only the multi-functional machines are of use in most family units. While these machines exercise the entire body, but only one muscle group at a time, they tend to be complex, spacious, not user friendly to all family members, and not aerobic.

Additionally, many of the above machines are complex in operation, using multiple moving parts, such as cables, pulleys, weights, stretch bands, and levers.

Specifically, applicant has developed a translational type machine with horizontal free planar motion which can exercise the user's entire lower or upper body, with one machine operation for each, using a single user body load path; is primarily aerobic in nature, using variable directional momentum as force resistance, and is able to provide supplemental user adjusted braking resistance for both push and pull, aerobic and anaerobic exercise; is easy to operate and adjust, and can be used by any member of the family, including the disabled; and has no user body impact or other detrimental affects. Finally, this machine is simple in construction, resulting in cost effectiveness.

BRIEF SUMMARY OF THE INVENTION

In accordance with the present invention, applicant provides a translational type exercise machine with horizontal free planar motion. The apparatus comprises of a horizontal base frame, an intermediate wheeled horizontal frame, which rides upon the base frame, with adjustable brakes to resist longitudinal motion; an upper wheeled horizontal frame, which rides upon the intermediate wheeled horizontal frame, with adjustable brakes to resist lateral motion; a vertical frame, which can be attached to the upper wheeled horizontal frame, or to the horizontal base frame, comprised of two vertical channel members, a horizontal handlebar member which is vertically adjustable, having sliding attachment to the vertical channel members, and having positionally adjustable hand/foot grips clamped to the horizontal handlebar; an upper horizontal rigid frame, which can be attached to the horizontal base frame, passing over the wheeled horizontal frames; and a seat and backrest assembly which support the user, which can be attached to the upper horizontal rigid frame, or to the upper wheeled horizontal frame.

It is therefore the object of the present invention to provide a translational type exercise machine with horizontal free planar motion, which makes use of the momentum of the user and the machine frames, to provide a uniform push and pull resistence throughout the exercise cycle.

It is another object of the present invention to provide a translational type exercise machine with horizontal free planar motion, which adds a two-directional frame braking system, to cause additional uniform push and pull resistence throughout the exercise cycle.

It is yet another object of the present invention to provide a translational type exercise machine with horizontal free planar motion, which makes use of hand/foot grips, which can be adjusted to any convenient height or spacing to provide a user selected variation in the orientation of the user body load path during said exercise cycle.

Some of the objects of the invention have been stated, other objects will become evident as the description proceeds, when taken in connection with the accompanying drawings described below.

DETAILED DESCRIPTION OF THE INVENTION

Figure 1:
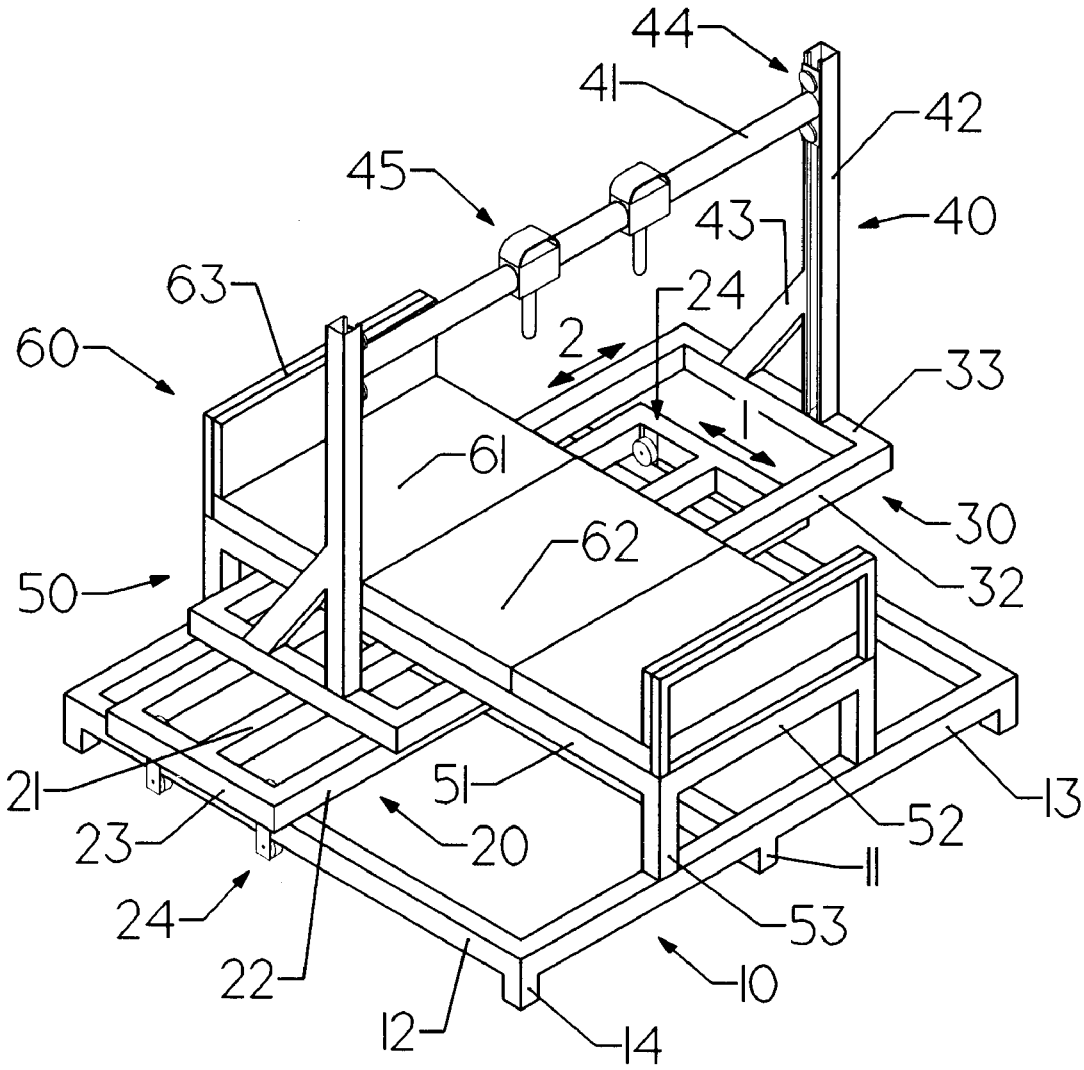
FIG. 1 is a perspective of the translational type exercise machine embodying Configuration No. 1 of the present invention.
Figure 2:
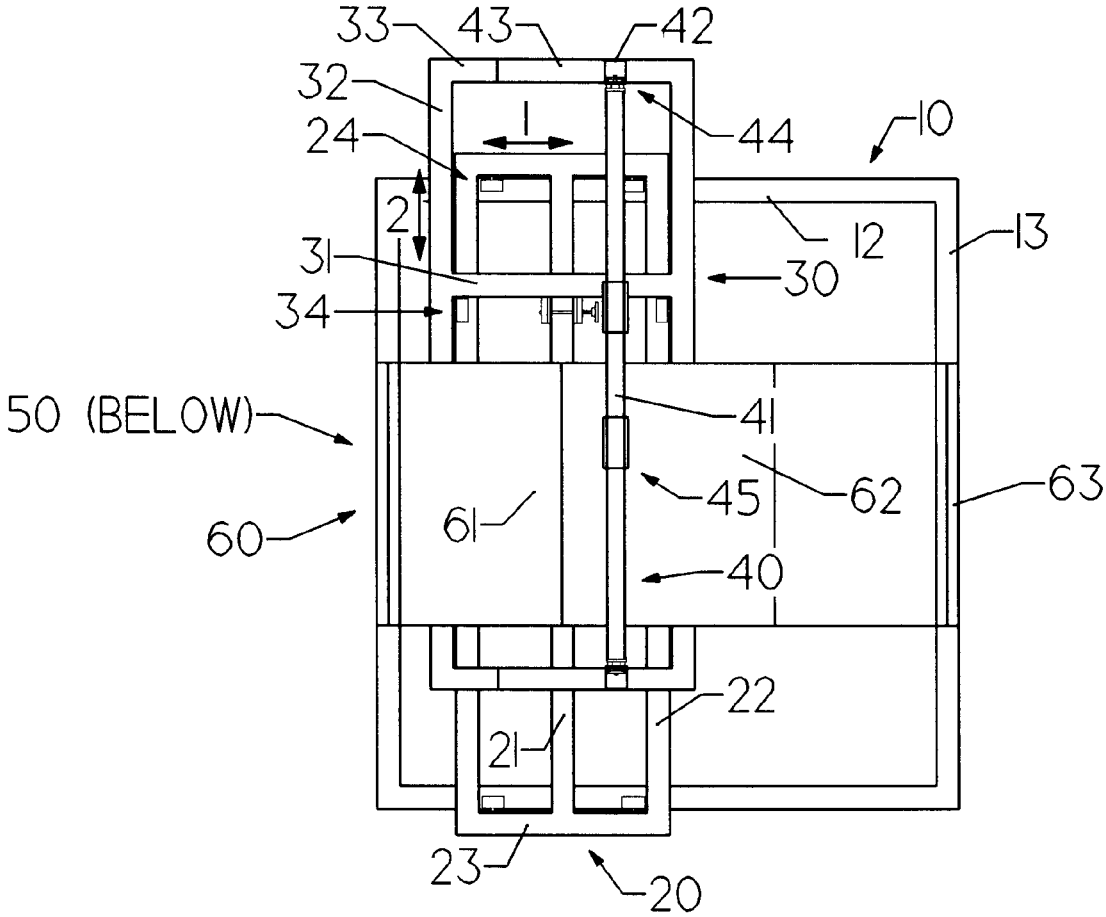
FIG. 2 is a plan view of Configuration No. 1 of the exercise machine.
Figures 3, 4, 5, 6, 7:
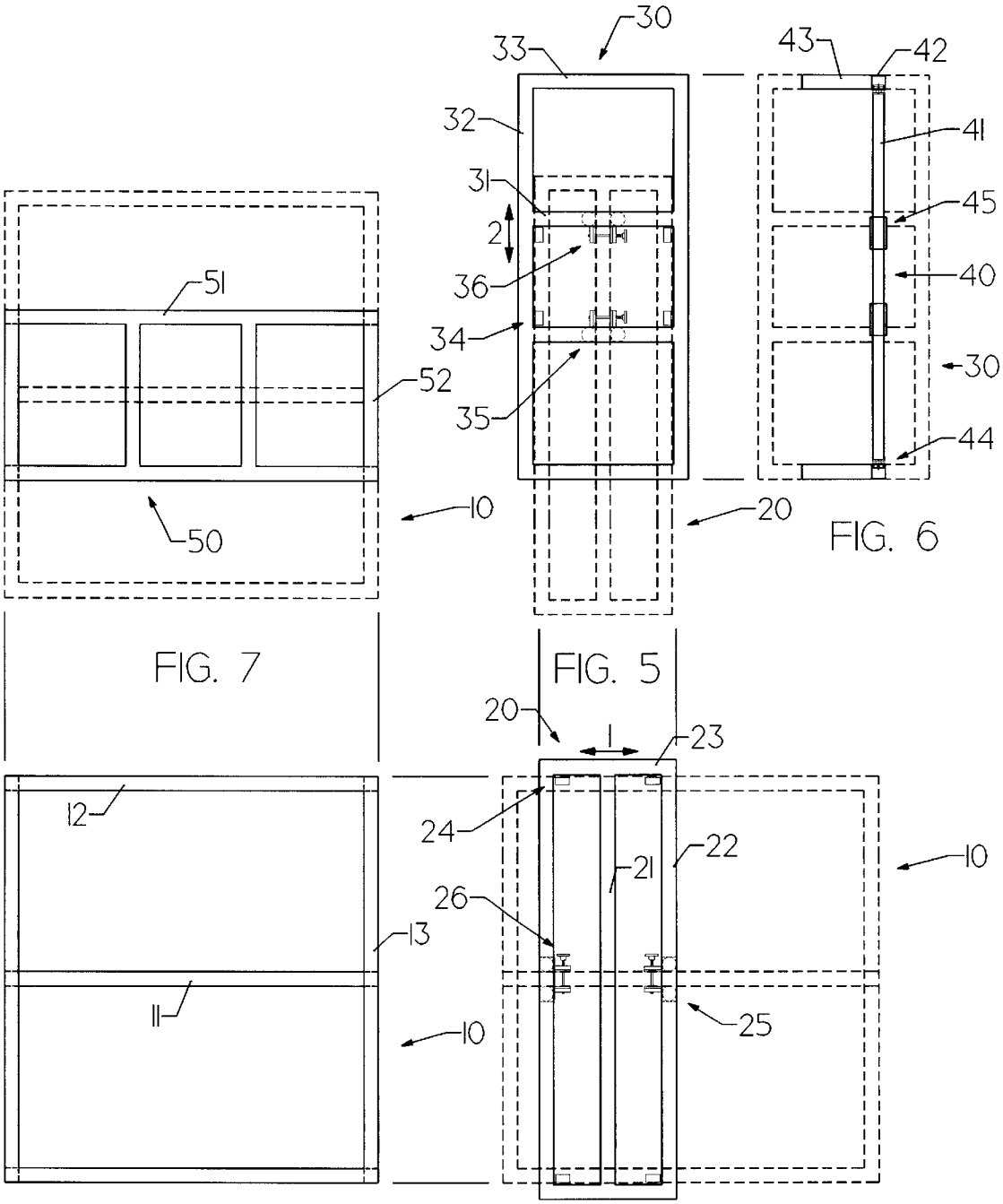
FIG. 3 is a plan view of Configuration No. 1 of the horizontal base frame.
FIG. 4 is a plan view of Configuration No. 1 of the intermediate wheeled horizontal frame.
FIG. 5 is a plan view of Configuration No. 1 of the upper wheeled horizontal frame.
FIG. 6 is a plan view of Configuration No. 1 of the vertical handlebar frame.
FIG. 7 is a plan view of Configuration No. 1 of the upper horizontal rigid frame which supports the user (seat pad and backrests not shown)
Figure 8:
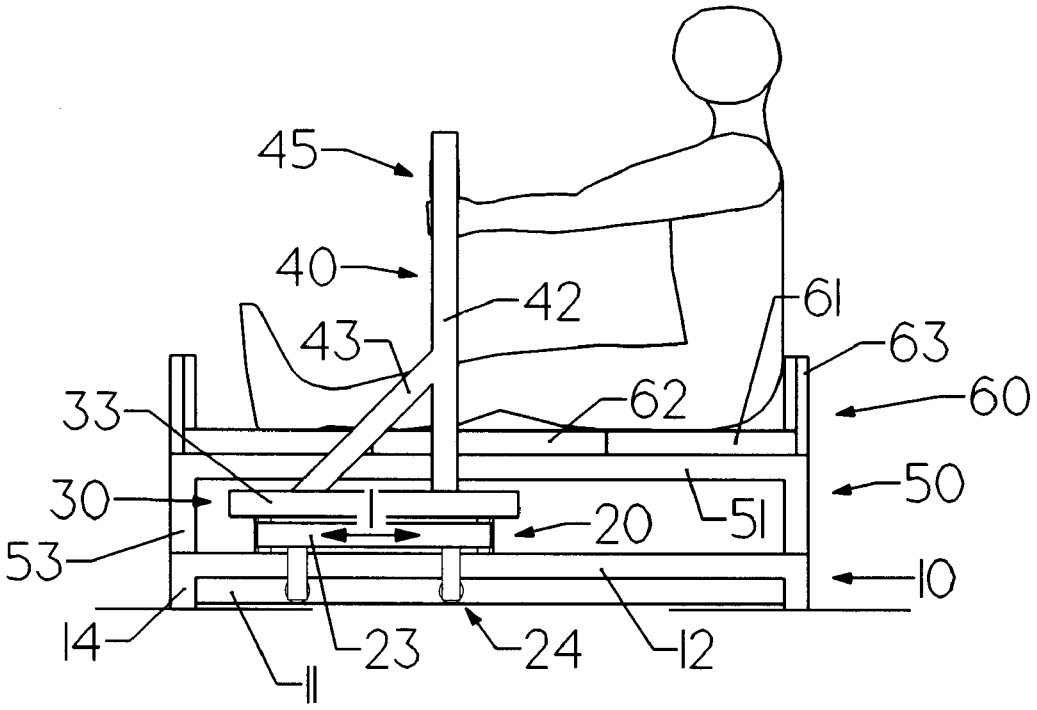
FIG. 8 is a side elevation of Configuration No. 1 of the exercise machine showing the front-to-back translational motion of the first of the two primary operating modes, upper body exercise.
Figure 9:
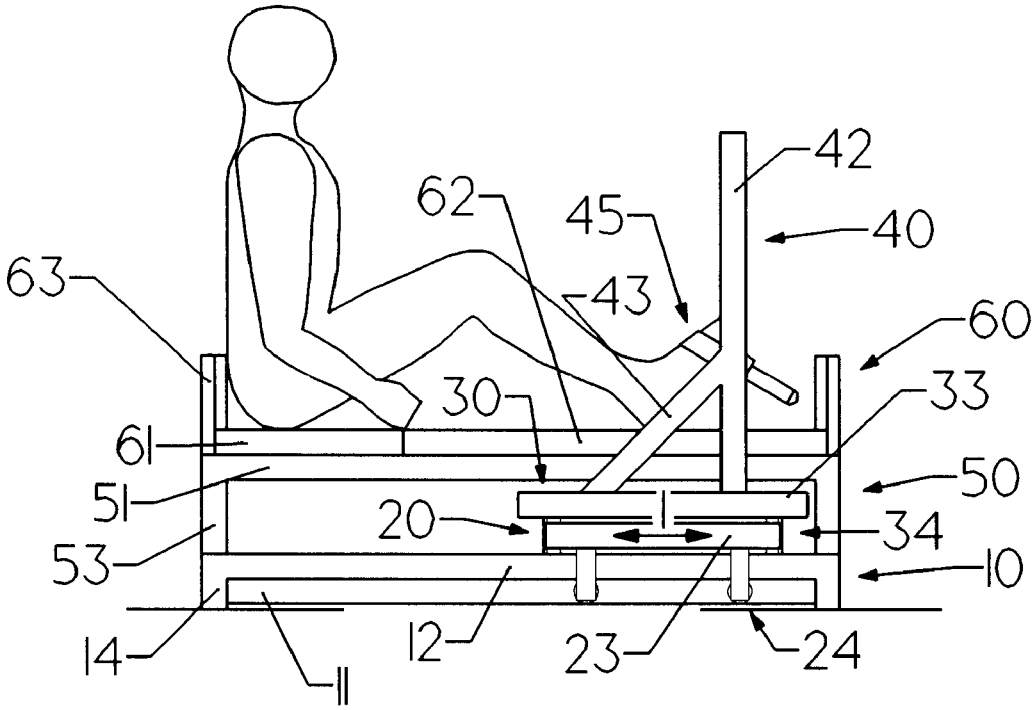
FIG. 9 is a side elevation of Configuration No. 1 of the exercise machine showing the front-to-back translational motion of the second of the two primary operating modes, lower body exercise.
Figure 10:
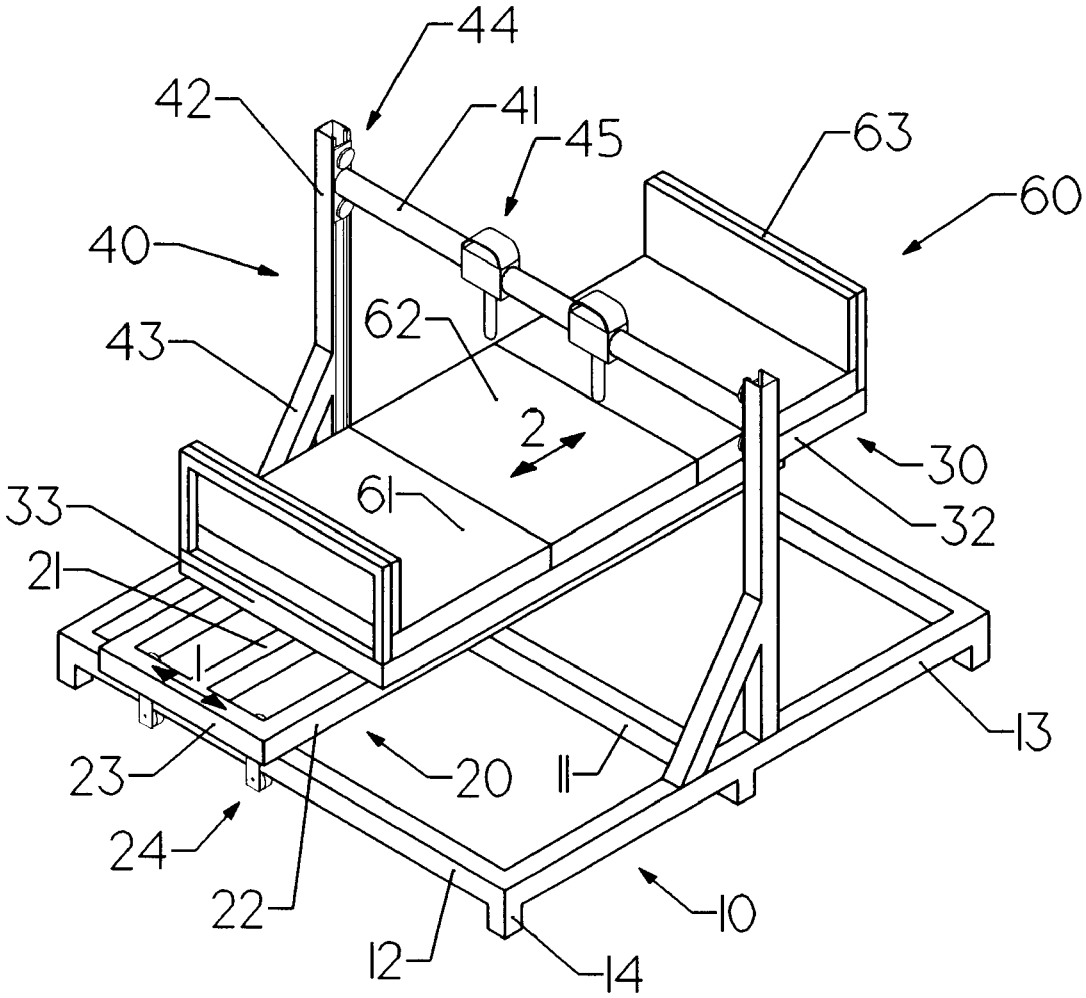
FIG. 10 is a perspective of the translational type exercise machine embodying Configuration No. 2 of the present invention.
Figure 11:
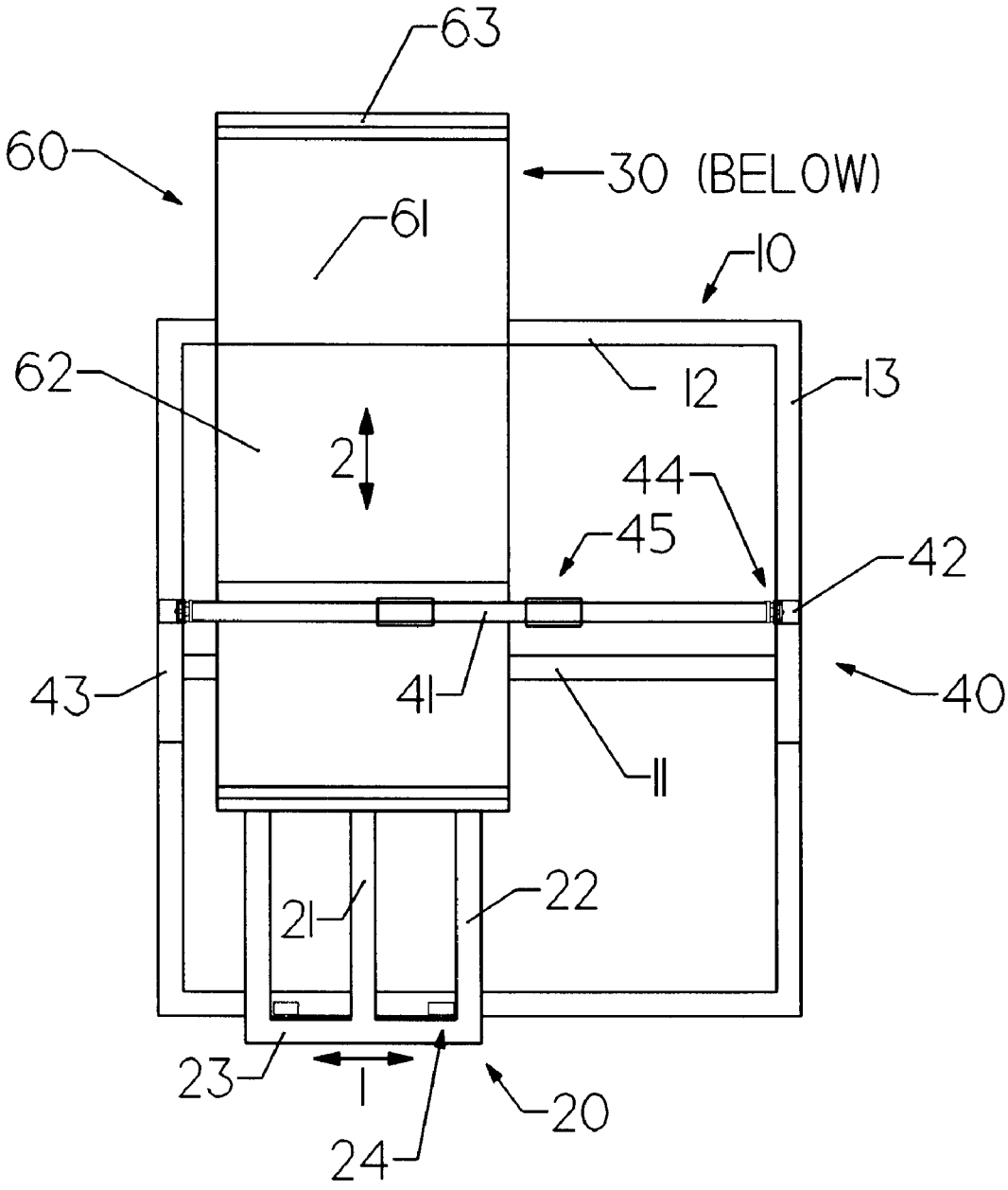
FIG. 11 is a plan view of Configuration No. 2 of the exercise machine.
Figure 15:
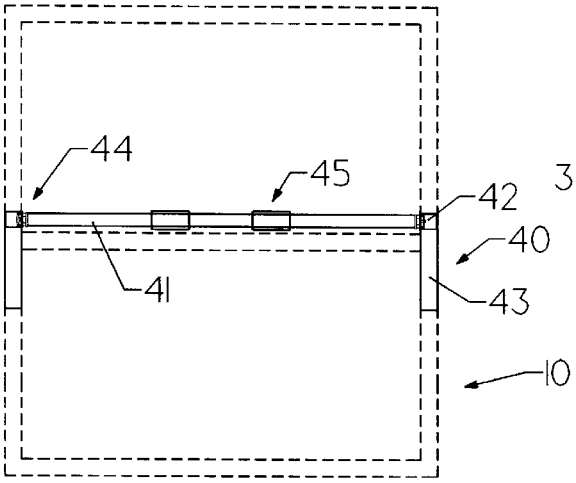
FIG. 15 is a plan view of Configuration No. 2 of the vertical handlebar frame.
Figure 14:
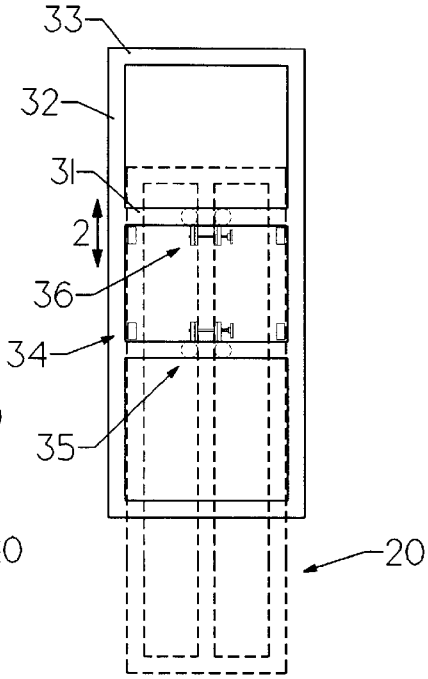
FIG. 14 is a plan view of Configuration No. 2 of the upper wheeled horizontal frame (seat pad and backrests not shown)
Figure 12:
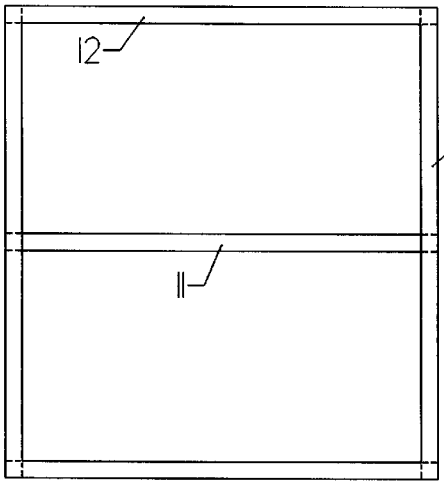
FIG. 12 is a plan view of Configuration No. 2 of the horizontal base frame.
Figure 13:
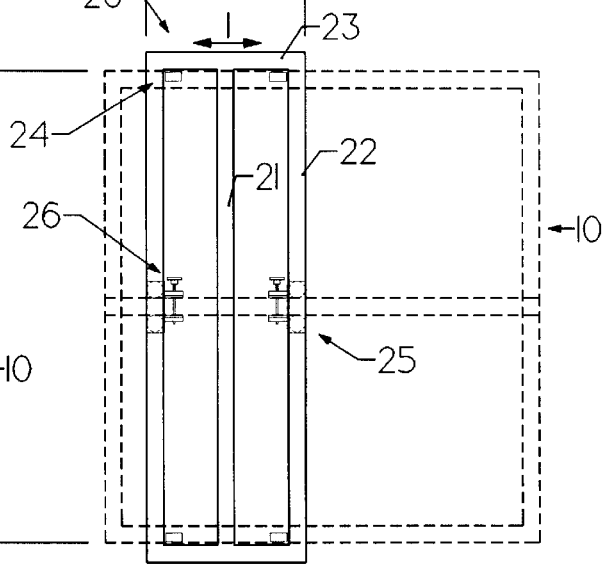
FIG. 13 is a plan view of Configuration No. 2 of the intermediate wheeled horizontal frame.
Figure 16:
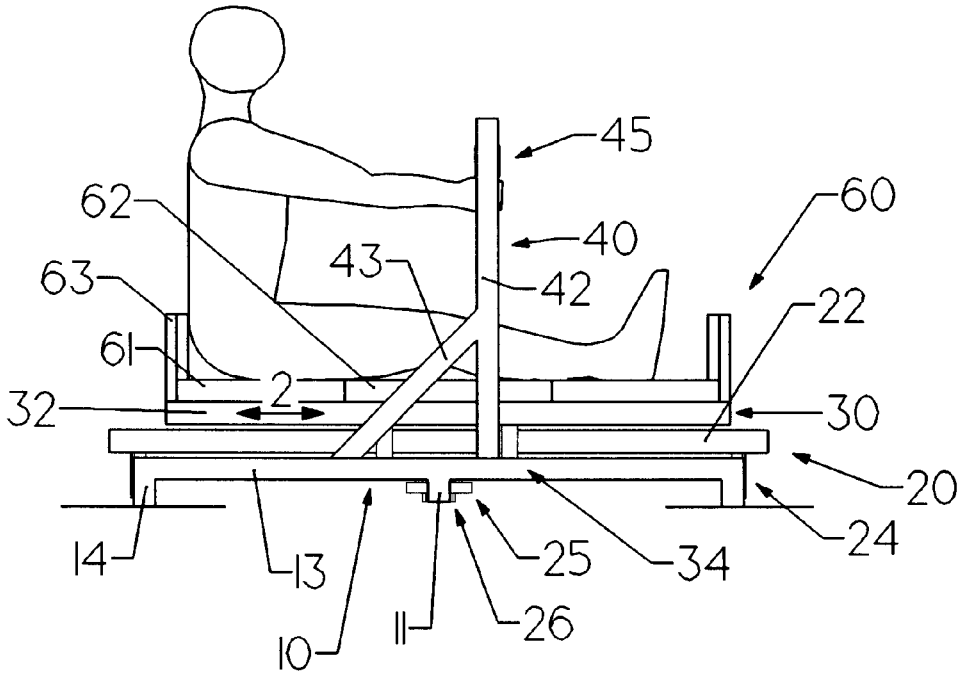
FIG. 16 is a side elevation of Configuration No. 2 of the exercise machine showing the front-to-back translational motion of the first of the two primary operating modes, upper body exercise.
Figure 17:
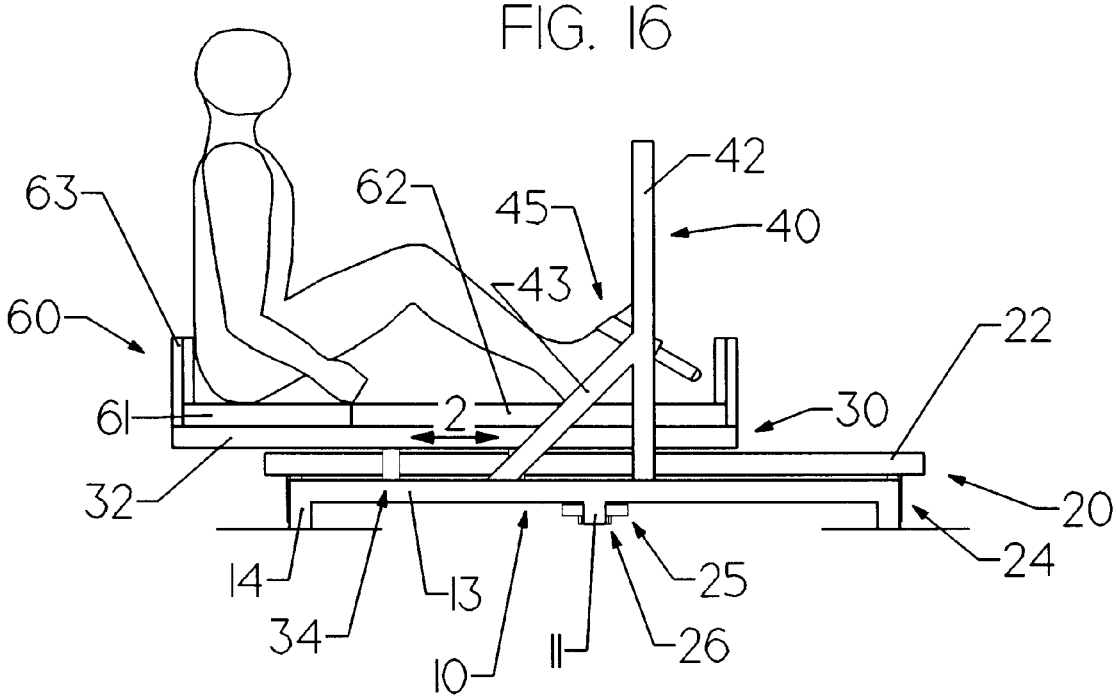
FIG. 17 is a side elevation of Configuration No. 2 of the exercise machine showing the front-to-back translational motion of the second of the two primary operating modes, lower body exercise.

Referring to FIGS. 1 through 17, the preferred embodiment of a translational type exercise machine according to the present invention is shown to comprise a base frame 10, an intermediate wheeled frame 20, an upper wheeled frame 30, a vertical handlebar frame 40 with hand/foot grips, a upper horizontal rigid support frame 50, and a seat and backrest assembly 60.

Base Frame 10 includes two rails 12 which support intermediate wheeled frame 20; one guide and braking rail 11 which guides and assists braking for intermediate wheeled frame 20; two horizontal members 13 which support horizontal frame 50 or vertical handlebar frame 40, and support posts 14. Said support rails 12 are rigidly connected at each end to transverse members 13 and vertical posts 14. Said guide and braking rail 11 is rigidly connected at each end to the underside of said transverse members 13. Said members 13 are rigidly connected at each end to members 12 and vertical posts 14.

Intermediate Wheeled Frame 20 includes two horizontal rails 22 which support upper wheeled frame 30, and one horizontal guide and braking rail 21 which guides and assists braking for upper wheeled frame 30. Said rails 21 and 22 are rigidly connected at each end to horizontal members 23. Intermediate frame 20 includes four vertical wheel assemblies 24 (FIG. 18) attached to members 23 for riding along above and below frame 10, rail 12. Intermediate frame 20 also includes two horizontal wheel assemblies 25 (FIG. 21), attached below members 22 by way of bent plate 69, which ride along frame 10, guide rail 11 in order for frame 20 to maintain its directional orientation with respect to frame 10. Intermediate frame 20 further includes two braking clamps 26 (FIG. 21), attached to member 22 by way of bent plate 69, which clamp to frame 10, braking rail 11, for the purpose of resisting a first direction of frame 20.

Upper Wheeled Frame 30 includes two horizontal members 31, which are rigidly connected at their ends to two horizontal members 32, which are rigidly connected at their ends to two horizontal members 33. Upper frame 30 also includes four vertical wheel assemblies 34 (FIG. 18) attached to member 32 for riding along above and below frame 20, rail 22. Upper frame 30 also includes two horizontal wheel assemblies 35 (FIG. 19), attached below member 31, which ride along frame 20, guide rail 21, in order for frame 30 to maintain its directional orientation with respect to frame 20. Frame 30 further includes two braking clamps 36 (FIG. 20), attached to members 31, which clamp to frame 20, braking rail 21, for the purpose of resisting a second direction of frame 30.

Figure 22:
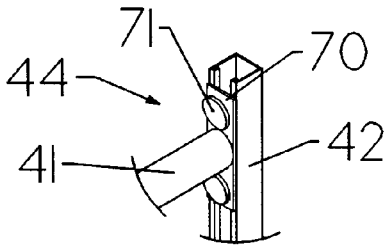
FIG. 22 is an exploded perspective of the horizontal handlebar vertical adjustment clamping mechanism.

Vertical Handlebar Frame 40 includes two vertical channel posts 42; a horizontal pipe handlebar member 41 for optional gripping, which includes two hand/foot grips 45 (FIG. 23) which are pivotally and longitudinally clamped to member 41; and two diagonal brackets 43. Said member 41 is slidingly attached at each end to vertical channel members 42, with clamping devices 44 (FIG. 22). Said diagonal members 43 are rigidly connected at their upper end to member 42, for the purpose of supporting and stiffening member 41. Said members 42 and 43 are attached at their lower end to frame 30, member 33, or to frame 10, member 13.

Upper Horizontal Rigid Support Frame 50 includes two horizontal members 51 and four horizontal members 52 which rigidly connect at their ends, and all of which are rigidly supported by four vertical corner posts 53. Posts 53 are attached at their lower end to frame 10, members 13.

Figure 20:
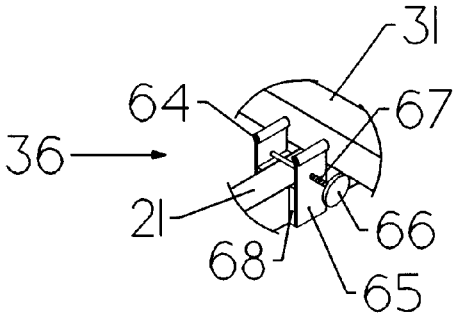
FIG. 20 is an exploded perspective of the braking mechanism for the upper wheeled frame.

Seat and Backrest Assembly 60 is comprised of two fixed seat pads 61, one removable seat pad 62, and two framed backrests 63. Removable seat pad 62 is for the purpose of access for adjusting brake clamps 26 (FIG. 21) and 36 (FIG. 20). Seat and backrest assembly 60 is attached on top of upper horizontal rigid support frame 50 or upper wheeled horizontal frame 30.

Figure 18:
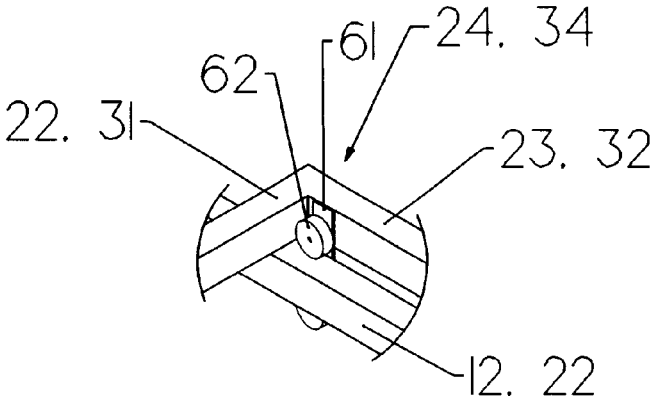
FIG. 18 is an exploded perspective of the support wheels for the wheeled frames.

A Vertical Wheel Assembly 24 and 34, shown in FIG. 18, is comprised of one vertical plate 61, rigidly attached to frame 20 or 30, which holds two bolted wheels 62, which roll above and below along frame 10, members 12 or frame 20, members 22, for the purpose of supporting frames 20 or 30 under a downward or upward loading conditions.

Figure 19:
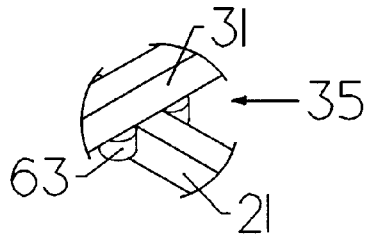
FIG. 19 is an exploded perspective of the guide wheels for the upper wheeled frame.
Figure 21:
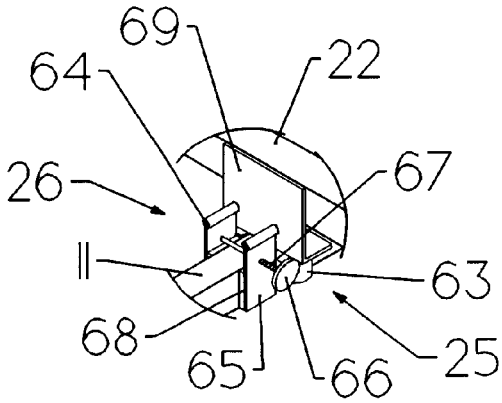
FIG. 21 is an exploded perspective of the guide wheels and braking mechanism for the intermediate wheeled frame.

A Horizontal Wheel Assembly 25 and 35, shown in FIGS. 21 and 19 respectively, is comprised of two bolted wheels 63, attached to frame 20, member 22 by way of bent plate 69 (FIG. 21), or to frame 30, member 31 (FIG. 19), which roll along both sides of frame 10, member 11 or frame 20, member 21, for the purpose of causing frames 20 and 30 to maintain their directional orientation, with respect to frames 10 and 20 respectively.

A Braking Clamp 26 and 36, shown in FIGS. 21 and 20 respectively, is comprised of two bolts 64 which pivotally connect plates 65 to frame 20, member 22 by way of bent plate 69 (FIG. 21), or to frame 30, member 31 (FIG. 20). Plates 65 are pulled together by knob bolting device 66, which applies pressure by way of spring 67, for the purpose of providing a more flexible adjustment. Plate member 65 applies pressure to frame 10, member 11 or to frame 20, member 21 by way of frictional element 68. The preferred material for element 68 is hard rubber.

A Horizontal Handlebar Vertical Adjustment Clamping Mechanism 44, shown in FIG. 22, is comprised of one plate 70 along the face of member 42 and two knob bolts 71, with threaded plates inside member 42. Tightening of knob bolts 71 causes threaded plates to clamp to channel member 42, stopping vertical sliding motion of handlebar 41 with respect to member 42.

Figure 23:
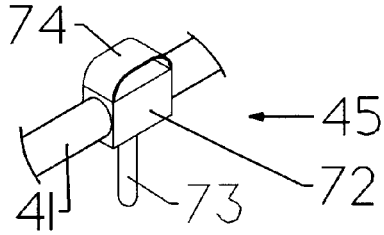
FIG. 23 is an exploded perspective of the hand/foot grip on the horizontal handlebar.

A Hand/Foot Grip 45, shown in FIG. 23, is comprised of a steel box 72 with circular <cutouts to match member 41; a hand grip 73 which is rotated to cause clamping action against handlebar member 41, thus restraining pivotal and longitudinal motion of the hand/foot grips 45 with respect to member 41; and an adjustable, flexible strap 74, attached to steel box 72, for the purpose of inserting the users foot for push/pull action.

EXERCISE

The present invention includes two configurations for exercise. Configuration No. 1 allows the user to remain stationery upon the upper horizontal rigid support frame, moving the horizontal wheeled frames below by way of the vertical handlebar frame, attached to the upper horizontal wheeled frame. Configuration No. 2 allows the user to ride upon the upper horizontal wheeled frame, propelling self and the horizontal wheeled frames by way of the stationery vertical handlebar frame, attached to the base frame.

When horizontal motion of the wheeled frames, and user for Configuration No. 2, is caused by use of the hand grips, the body load path is through the hands, arms, shoulders, and upper body, causing exercise of all muscle groups in these areas. A secondary effect is in the muscles of the lower body due to stabilization. The degree of strain is through use of the braking systems, as determined by the user.

When horizontal motion of the wheeled frames, and user for Configuration No. 2, is caused by use of the foot grips, the body load path is through the feet, legs and hips, causing exercise of all muscle groups in these areas. A secondary effect is in the muscles of the upper body due to stabilization. The degree of strain is through use of the braking systems, as determined by the user.

ALTERNATIVES AND ENHANCEMENTS

It will be understood that various details of the invention may be changed without departing from the scope of the invention; for example, variations in material, member and element types, motion resisting devices, and functional conveniences are possible. It is also noted that, while the present invention is described as a machine with two-directional planar motion, the machine can be reduced to a one-directional linear motion by eliminating one wheeled frame. Furthermore, the foregoing description is for the purpose of illustration only, and not for the purpose of limitation, the invention being defined by the claims. The present invention represents what is considered to be the basic best configuration for the intended purpose.

What I claim as my invention is:

1. An exercise machine comprising:

(a) a base frame;

(b) an intermediate wheeled horizontal frame atop a base frame for allowing a user to move said intermediate wheeled frame in a first direction, with:

(1) brake mechanisms connected to said intermediate wheeled frame are provided for movement resistance in said first direction;

(c) an upper wheeled frame atop said intermediate wheeled frame for allowing the user to move said upper wheeled frame in a second direction, with:

(1) brake mechanisms connected to said upper wheeled frame are provided for movement resistance in said second direction:

(d) a horizontal handlebar slidingly attached to vertical posts, said posts facilitating vertical positioning of said horizontal handlebar wherein said posts are attached atop at least one of said frames;

(1) said horizontal handlebar including a pair of hand/foot grips, which can be adjusted pivotally about and along said horizontal handlebar to suit hand and foot positioning of the user;

(2) whereby the user can move their body and said wheeled frames in any horizontal direction;

(e) an upper horizontal rigid support frame supported atop at least one of said frames;

(f) at least one of said frames including a seat and backrest assembly for support of a user having at least one removable section for adjusting said brake mechanisms.

* * * * *